US007197827B2

(12) United States Patent
Paquette

(10) Patent No.: US 7,197,827 B2
(45) Date of Patent: Apr. 3, 2007

(54) RAZOR HANDLE HAVING AN ATTACHMENT STRUCTURE

(76) Inventor: François Paquette, 6615 Esplanade Ravel, Laval, QBC (CA) H7H 1B2

( * ) Notice: Subject to any disclaimer, the term of this patent is extended or adjusted under 35 U.S.C. 154(b) by 0 days.

(21) Appl. No.: 10/140,173

(22) Filed: May 8, 2002

(65) Prior Publication Data

US 2003/0208913 A1 Nov. 13, 2003

(51) Int. Cl.
*B26B 21/40* (2006.01)
*A45D 27/22* (2006.01)
*B26B 21/52* (2006.01)

(52) U.S. Cl. ..... 30/526; 30/298.4; 30/541; 224/268; 248/690; 248/692

(58) Field of Classification Search ..... 30/34.05, 30/298.4, 526, 541, 325, 32, 537, 296.1, 30/298.1; D6/526; D28/48; 24/369; 81/DIG. 1; 224/255, 268; 248/339, 692, 690
See application file for complete search history.

(56) References Cited

U.S. PATENT DOCUMENTS 3,864,048 A * 2/1975 Parker ..... 403/27
D242,772 S * 12/1976 Marlow ..... D9/521
4,064,625 A * 12/1977 Mansfield ..... 30/537
4,188,717 A * 2/1980 Mansfield ..... 30/537
4,198,745 A 4/1980 Moehlenpah
4,275,862 A * 6/1981 Takagi et al. ..... 248/205.3
D271,746 S * 12/1983 Pieri ..... D9/521
4,432,136 A 2/1984 Taylor
D277,434 S * 2/1985 Iten ..... D6/526
D278,120 S * 3/1985 Grant et al. ..... D9/521 X
D279,256 S * 6/1985 Lang ..... D9/521
D283,260 S 4/1986 Alvarez
4,644,645 A 2/1987 Audet
4,658,505 A 4/1987 Williams
4,709,893 A * 12/1987 Ljungberg ..... 248/692
4,725,027 A * 2/1988 Bekanich ..... 248/125.8
4,728,006 A * 3/1988 Drobish et al. ..... 222/181.3
4,776,094 A * 10/1988 Glesser ..... 30/298.4 X
D369,049 S 4/1996 Scaglione
D371,479 S * 7/1996 Hirst ..... D9/520 X
5,628,117 A * 5/1997 Glesser ..... 30/298.4
5,687,485 A 11/1997 Shurtleff et al.
5,839,198 A 11/1998 McCoy
5,875,511 A * 3/1999 Nejdl ..... 15/176.1
5,911,480 A 6/1999 Morgan
5,913,317 A 6/1999 Tiram
D426,918 S * 6/2000 Greene ..... D28/48
6,263,582 B1 7/2001 Wade
6,594,906 B1 * 7/2003 Sakai et al. ..... 30/298.4 X

* cited by examiner

*Primary Examiner*—Clark F. Dexter
(74) *Attorney, Agent, or Firm*—Protections Equinox; Franz Bonsang, Patent Agent

(57) ABSTRACT

A razor handle supports a razor head, which is attachable to a supporting stem. The handle has an elongated body, which defines a body longitudinal axis, a razor head attachment member for attaching the razor head to said razor handle adjacent a body first end, and a handle-to-stem attachment member for attaching said razor handle adjacent a body second end to the stem. The attachment member has a slot, which defines a retention segment and an insertion segment. The retention segment defines a longitudinal axis, which is parallel to the body axis, and which leads into the retention segment. The insertion segment allows the stem to be inserted into the retention segment so that the razor handle can be suspended from the supporting stem.

7 Claims, 3 Drawing Sheets

RAZOR HANDLE HAVING AN ATTACHMENT STRUCTURE

FIELD OF THE INVENTION

The present invention relates to the general field of personal hygiene accessories and is particularly concerned with a razor handle having an attachment structure.

BACKGROUND OF THE INVENTION

Shaving razors are widely known and used for shaving various body parts such as faces and legs. Conventional wet-shave razors include a shaving head having shaving blades releasably or permanently mounted to a generally elongated razor handle. Razors having blades permanently mounted to the razor handle are sometimes referred to as safety razors and are discarded as a whole when the cutting edge of the blade has become dull. With removable blade razors, the blade unit is releasably mounted to the handle and is discarded when the cutting edge of the blade becomes dull. Various configurations of razor handle and razor blade units are found in the prior art.

During so-called wet-shaving, water or a shaving lubricant such as a shaving cream is applied to the area of the body about to be shaved. The razor blades are then positioned against the lubrified body area and the handle is used to pull the blade along the skin across the area to be shaved. The blades are angled so as to cut the unwanted hair adjacent the skin. The operation is repeated until the shaving operation is considered satisfactory. Razor handles are often recycled for various shaving operations. Indeed, with removable blade housing razors, the same handle is used indefinitely as only the blade housing is changed when needed. The increase in cost associated with even more sophisticated safety razors is such that they are also often reused a number of times before being discarded. A need thus arises for storing razor handles between uses.

The prior art is replete with various structures attempting to provide a solution to the problem of storing razor handles between uses. Some prior art solutions such as disclosed in U.S. Pat. No. 5,913,317 naming Aaron TIRAM as inventor and issued Jun. 22, 1999 and U.S. Design Pat. No. 369,049 naming William SCAGLIONE as inventor issued Apr. 23, 1996 propose separate holders for mounting the handles to a supporting surface. This type of structure suffers from numerous drawbacks including the fact that the holders need to be secured to a generally flat surface. Also, they require either permanent fixing which may prove detrimental to the surface and/or to the holder or are reduced to being releasably mounted to a vertical surface with consequent potential risk of falling off from the surface and creating a dangerous situation if a razor is attached thereto.

These prior art structures also suffer from the fact that the intended user needs to purchase an additional structure, namely the supporting structure. Also, the supporting structure is not always available, as for example, when the intended user travels to a remote location. The user would then need to carry not only razors but supporting structures therefor.

Other prior art documents such as U.S. Pat. No. 5,839,198 naming Claire MCCOY as inventor issued Nov. 24, 1998; U.S. Design Pat. No. 283,260 naming Gabriel ALVAREZ as inventor, issued Apr. 1, 1986 and U.S. Pat. No. 4,644,645 naming Gerald AUDET as inventor and issued Feb. 24, 1987 propose holders formed integrally with or extending from the razor itself. The purposed structures, although presenting the advantage of being part of the razor, nevertheless suffer from numerous drawbacks. For example, most of these prior art structures protrude from the razor handle, and, they increase the volume required for transportation and storage. Also, the protruding sections are subjected to being broken-off during shipping and handling. Furthermore, the prior art structures are designed to support the razor with its razor head positioned above the handle. Consequently, water mixed with shaving and/or other lubricants and cut pieces of hair will tend to drip down onto the handle and dry thereon leading to a messy handle before the latter is subsequently used. Furthermore, most of the prior art structures are overly complex leading to increased undue manufacturing costs.

Other prior art structures such as that disclosed in U.S. Pat. No. 5,687,485 naming Jill Marie SHURTLEFF et al. as inventors issued Nov. 18, 1997 discloses a handle structure defining a section that could be used for suspending the razor on a supporting structure. However, the handle configuration is not specifically intended for that use and, hence, also suffers from drawbacks. For example, the structure disclosed in U.S. Pat. No. 5,687,485 cannot be suspended from a closed loop-type of supporting structure and is not specifically adapted to being hung on a supporting structure. Accordingly, such structure can only be unstably attached to a limited type of supporting structures. Consequently, there exists a need for an improved razor handle having an attachment structure.

SUMMARY OF THE INVENTION

It is an object of the present invention to provide an improved razor handle having an attachment structure.

Advantages of the present invention include that the proposed razor handle is specifically designed so as to be attachable to various types of supporting structures including closed-loop type supporting structures so as to securely and releasably attach a razor handle thereto. Also, the proposed razor handle is designed so as to attach a razor handle to a supporting structure with the razor head section positioned underneath the handle so as to reduce the risks of soiling the razor handle with shaving debris.

Furthermore, the proposed razor handle is designed so as to facilitate attachment and removal of the handle structure to and from a supporting structure through a set of quick, easy, safe and ergonomic steps without requiring manual dexterity.

Furthermore, the proposed razor handle is designed so that its weight is substantially centered about its longitudinal axis when in an attached configuration relative to a supporting structure so as to reduce the risks of having the handle fall off from the supporting structure.

Other advantages associated with the proposed razor handle resides in the fact that since the handle is designed so that the razor head is positioned underneath the handle when in the suspended configuration, the overall weight distribution of the handle and shaving head combination is such that most of the weight is located at the bottom of the structure and, hence, the center of gravity of the combination will remain more easily within the sustentation base. The risks of having the razor with its razor head knocked off from the supporting structure is thus reduced with consequent risks of potential injury resulting from having the razor with its blade fall on the body of the intended user.

Still further, the proposed razor handle is designed so that its attachment structure may substantially conform to the overall volume of the conventional handle without creating protruding segments so as to reduce required storage space and so as to reduce the risk of having segments thereof damaged during shipping and handling.

Furthermore, in at least one embodiment of the invention, the proposed razor handle is provided with a retrofittable adaptor for retrofitting to existing conventional razor handles.

Overall, the proposed razor handle is further designed so as to be manufacturable through conventional manufacturing processes using conventional material such as a polymeric resins so as to produce a razor handle that will be economically feasible, long lasting and relatively trouble free in operation.

According to an aspect of the present invention, there is provided a razor handle for supporting a razor head, the razor handle being attachable to a supporting stem, the razor handle comprises:

- a generally elongated body, the body defining a body longitudinal axis, a body first end and a generally opposed body second end;
- a razor head attachment means for attaching the razor head to the razor handle adjacent the body first end, the razor head attachment means being at least partially coverable on an external surface thereof by the razor head;
- a handle-to-stem attachment means for attaching the razor handle adjacent the body second end to the supporting stem, the handle-to-stem attachment means including an attachment slot, the attachment slot defining a retention segment and an insertion segment, the retention segment defining a retention segment longitudinal axis extending in a generally parallel relationship relative to the body longitudinal axis, the insertion segment leading into the retention segment, the insertion segment allowing the stem to be inserted into the retention segment and the retention segment allowing the razor handle to be suspended from the supporting stem with the razor head positioned substantially underneath the body second end.

Typically, the retention segment longitudinal axis extends in a generally co-linear relationship relative to the body longitudinal axis.

Typically, the insertion segment defines an insertion segment axis extending in a generally perpendicular relationship relative to the retention segment axis.

Preferably, the insertion segment extends through a side peripheral edge of the body and merges with the retention segment.

Preferably, the insertion segment has a generally J-shaped configuration defining an insertion segment first portion, the insertion segment first portion defining a first portion axis extending in a generally parallel and spaced relationship relative to the retention segment axis and an insertion segment second portion extending between the insertion segment first portion and the retention segment.

Preferably, the insertion segment second portion extends in a generally perpendicular relationship relative to the insertion segment first portion and the retention segment.

Preferably, the insertion segment first portion extends through an end peripheral edge of the body and merges with the insertion segment second portion, the insertion segment second portion merging with the retention segment.

Typically, the handle-to-stem attachment means is formed integrally with the body adjacent the body second end, the attachment slot extending into the body.

Alternatively, the handle-to-stem attachment means is releasably attachable to the handle adjacent the body second end.

Preferably, the handle-to-stem attachment means includes an attachment adaptor, the attachment adaptor being releasably attachable to the body, the attachment adaptor defining an adaptor sleeve section, the adaptor sleeve section defining a sleeve channel configured and sized for slidable insertion over the body adjacent the body second end, the attachment adaptor further defining an adaptor protruding segment, the attachment slot being formed in the adaptor protruding segment.

Typically, the attachment slot is provided with a generally rounded contour having rounded corners.

Preferably, the attachment adaptor is provided with an adaptor locking means for locking the attachment adaptor to the body of the handle. The adaptor locking means includes a frictional contact between an inner surface of the sleeve channel and the body of the handle.

Alternatively, the attachment means is provided with an insertion segment blocking means for blocking the insertion segment so as to selectively prevent withdrawal of the supporting stem therefrom.

Preferably, the insertion segment blocking means includes a flap extending longitudinally across the insertion segment and resiliently pivoting to a flap open configuration from a flap blocking configuration wherein it allows and prevents passage of the supporting stem therethrough, respectively.

Preferably, the flap extends from a surface of the insertion segment adjacent a lateral surface of the handle body.

Other objects and advantages of the present invention will become apparent from a careful reading of the detailed description provided herein, within appropriate reference to the accompanying drawings.

BRIEF DESCRIPTION OF THE DRAWINGS

In the annexed drawings, like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
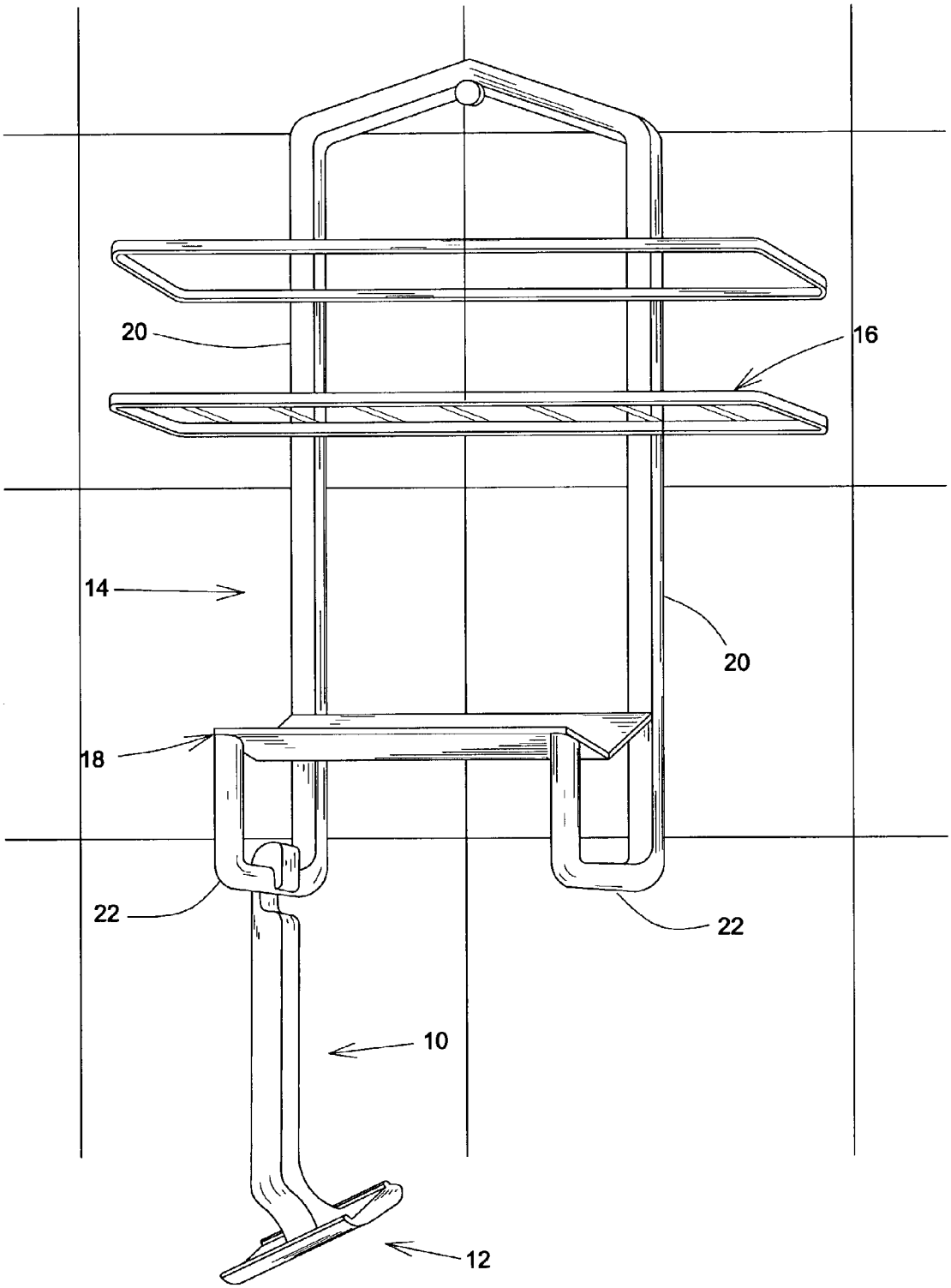
FIG. 1, in a perspective view, illustrates a first embodiment of a razor handle having an attachment structure in accordance with the present invention, the razor handle being shown with a conventional razor head attached thereto and being attached to a supporting stem part of a conventional shower soap holder.

Referring to FIG. 1, there is shown a first embodiment 10 of a razor handle in accordance with the present invention. The razor handle 10 is shown with a conventional razor blade 12 attached thereto. Although a specific simple configuration of the handle 10 is shown throughout the Figures and the razor blade 12 is shown throughout the Figures as being permanently attached to the handle 10, it should be understood that the razor handle 10 could assume other configurations and that the razor blade 12 could be releasably attached thereto without departing from the scoop of the present invention.

The razor handle 10 is shown in FIG. 1 as being releasably attached to a conventional shower-type soap holder 14. Typically, the conventional shower-type soap holder 14 includes a bottle-receiving platform 16 and a soap-receiving platform 18 attached to supporting rods 20. The supporting rods 20 typically define generally elongated supporting stems 22, one of which is used for attaching the razor handle 10. Again, it should be understood that although the razor handle 10 is shown as being attached to a supporting stem 22 part of a shower-type soap holder 14, the razor handle 10 could be used in other contexts and attached to other supporting structures without departing from the scope of the present invention.

Figure 2A:
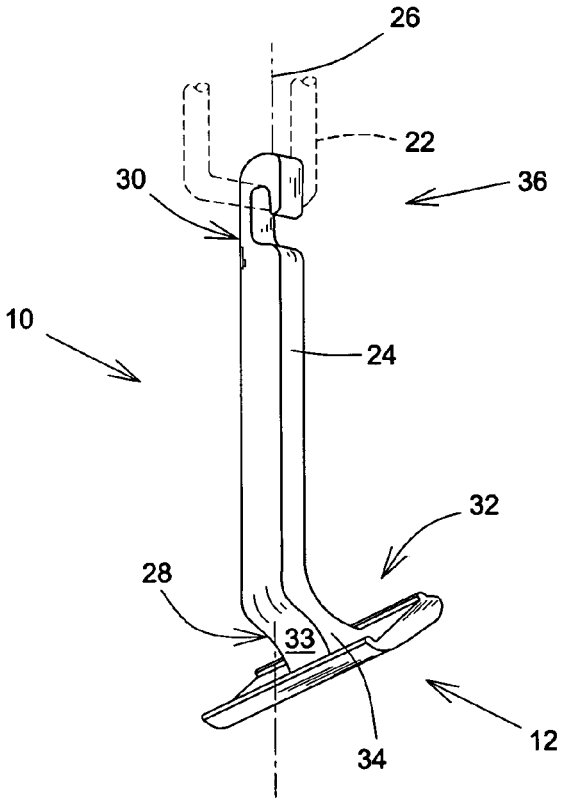
FIG. 2*a*, in a partial perspective view with sections taken out, illustrates the razor handle shown in FIG. 1 attached to a section of a supporting stem, the section of the supporting stem being shown in phantom lines.
Figure 2B:
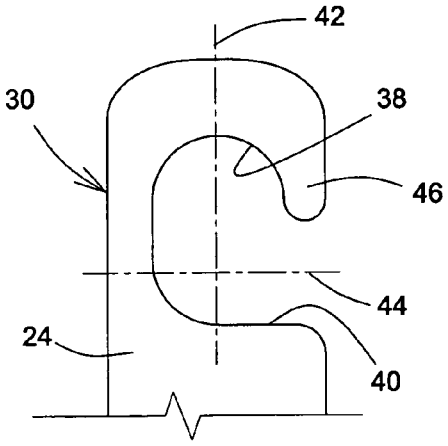
FIG. 2*b*, in a close-up detailed elevational view with sections taken out, illustrates the configuration of the attachment section part of the razor handle shown in FIG. 2*a;*

Referring now more specifically to FIG. 2, there is shown in greater details some of the characteristics of the razor handle 10. The razor handle 10 includes a generally elongated body 24. The body 24 defines a body longitudinal axis 26, a body first longitudinal end 28 and a generally opposed body second end 30.

The razor handle 10 includes a razor head attachment means 32 for attaching the razor head 12 to the razor handle 10 adjacent the body first end 28. In the embodiments shown in FIGS. 1 through 3, the razor head attachment means includes a handle-to-head attachment leg 34 extending integrally between the body first end 28 and the razor head 12 and having an external surface 33 which is at least partially covered by the razor head 12. As mentioned previously, the razor head 12 could be attached by a releasable attachment means to the handle 10 or could be permanently attached with other types of attachment means without departing from the scope of the present invention.

The razor handle 10 also includes a handle-to-stem attachment means 36 for attaching the razor handle 10 adjacent the body second end 30 to the supporting structure such as the supporting stem 22. The handle-to-stem attachment means 36 includes an attachment slot 36. The attachment slot 36 defines a retention segment 38 and an insertion segment 40. The retention segment 38 defines a retention segment longitudinal axis 42 extending in a generally parallel relationship relative to the body longitudinal axis 26. In a preferred embodiment of the invention, the retention segment longitudinal axis 42 extends in a generally co-linear relationship relative to the body longitudinal axis 26.

The insertion segment 40 is positioned so as to lead into the retention segment 38 and allows the supporting stem 22 to be slidably inserted from a position located outside the body 24 to a position wherein the supporting stem 22 is inserted into the retention segment 38. In the embodiment shown in FIGS. 1 through 2*b*, the insertion segment 40 extends through a side peripheral edge of the body 24 and into the retention segment 38. In the first embodiment of the invention, the insertion segment 40 thus defines an insertion segment axis 44 extending in a generally perpendicular relationship relative to the retention segment axis 42. The attachment slot 36 thus defines a generally L-shaped configuration with a first leg of the L-shaped configuration corresponding to the insertion segment 40 leading into the body 24 from inside peripheral edge thereof and the second leg of the L-shaped configuration corresponding to the retention segment 38 formed in the body 24 and oriented in a generally parallel relationship relative to the body longitudinal axis 26.

The inner surface of the attachment slot 36 is preferably given a generally rounded contour with rounded corners. Also, preferably, the intersection located externally between the retention and insertion segments 38, 40 defines a retention lip 46 having a generally rounding end.

Figure 3A:
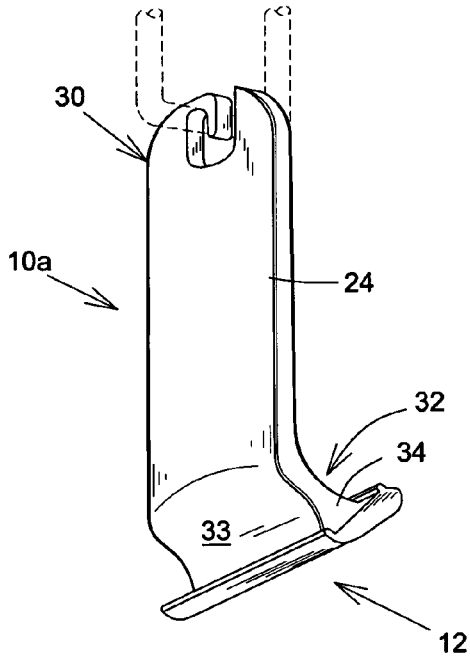
FIG. 3*a*, in a partial perspective view with sections taken out, illustrates a second embodiment of a razor handle having an attachment structure in accordance with the present invention, the razor handle being shown attached to a section of a supporting stem, the section of the supporting stem being shown in phantom lines.
Figure 3B:
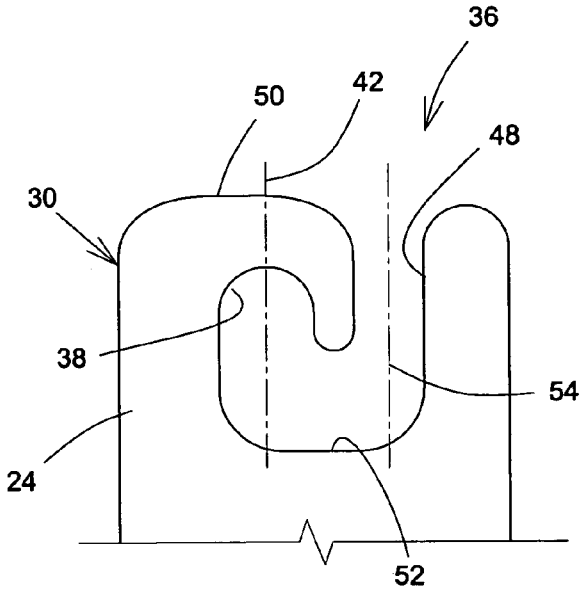
FIG. 3*b*, in a close-up detailed view with sections taken out, illustrates the configuration of the attachment section part of the razor handle shown in FIG. 2*a;*

Referring now more specifically to FIGS. 3*a* and 3*b*, there is shown in greater details some of the characteristics of a second embodiment 10*a* of a razor handle in accordance with the present invention. The razor handle 10*a* is substantially similar to the razor handle 10, and, hence, similar reference numerals will be used to the known similar components. One of the main differences between the razor handles 10 and 10*a*, respectively corresponding to first and second embodiments of the present invention, resides in the configuration and positioning of the attachment slot 36. In the embodiment shown in FIGS. 3*a* and 3*b*, the insertion segment has a generally J-shaped configuration defining an insertion segment first portion 48 extending from an end peripheral edge 50 of the body 24 into the latter and an insertion segment second portion 52 extending between the insertion segment first portion 48 and the retention segment 38. The insertion segment first portion 48 defines a first portion axis 54 extending in a generally parallel and space relationship relative to the extension segment axis 42. Typically, the insertion segment second portion 52 extends in a generally perpendicular relationship relative to both the insertion segment first portion 48 and the retention segment 38. The inner surface of the attachment slot 36 is again preferably provided with a rounded contour so as to facilitate smooth transition of the supporting stem 22 as it slides between all the segments and portions.

The razor handles 10 and 10*a* shown in FIGS. 1 to 3*b* are preferably provided with handle-to-stem attachment means formed integrally in the body 24 adjacent the handle second end 30. In the embodiment shown in FIGS. 1 through 3*b*, the razor handles 10, 10*a* include attachment slots 36 formed in the body 24.

Figure 5:
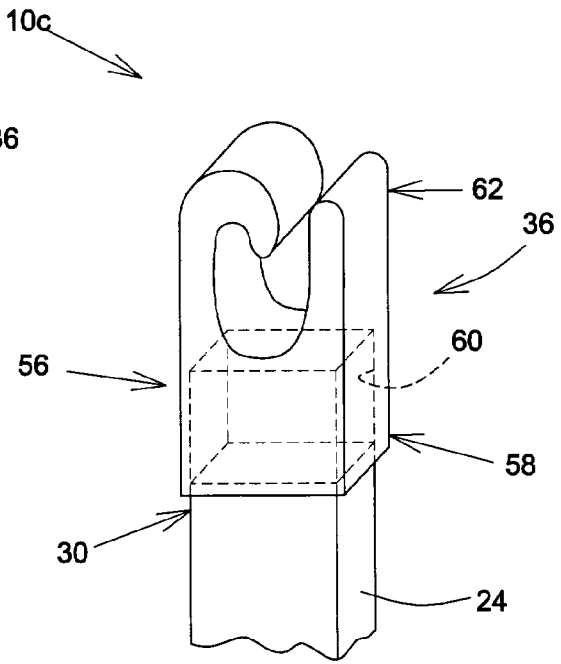
FIG. 5, in a partial perspective view with sections taken out, illustrates a forth embodiment of a razor handle having an attachment structure in accordance with the present invention.
Figure 4:
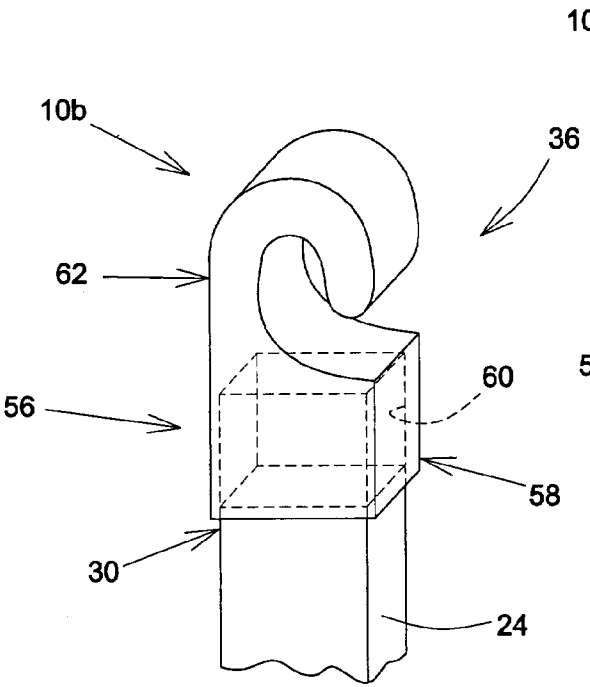
FIG. 4, in a partial perspective view with sections taken out, illustrates a section of a third embodiment of a razor handle having an attachment structure in accordance with the present invention.

Referring now more specifically to FIGS. 4 and 5, there is shown a third 10*b* and a fourth 10*c* embodiment of a razor handle, respectively, in accordance with the present invention. The razor handle 10*b* shown in FIG. 4 is substantially similar to the razor handle 10 shown in FIGS. 1 through 2*b* and, hence, similar reference numerals will be used to denote similar components. Similarly, the razor handle 10*c* shown in FIG. 5 is substantially similar to the razor handle 10*a* shown in FIGS. 3*a* and 3*b* and, hence, similar reference numerals will be used to denote similar components.

One of the main differences between the razor handles 10*b*, 10*c*, shown respectively in FIGS. 4 and 5, and the razor handles 10 and 10*a* shown in FIGS. 1 through 3*b*, resides in the fact that the handle-to-stem attachment means 36 of the razor handles 10*b* and 10*c* are releasably attachable to the handle 10 adjacent the handle second end 30 instead of being integral therewith. The handle-to-stem attachment means 36 of both the razor handles 10*b* and 10*c* includes an attachment adaptor 56 releasably attachable to the body 24. The attachment adaptor 56 includes an adaptor sleeve section 58 defining a sleeve channel 60 configured and sized for slidable insertion over the body 24 adjacent the handle second end 30. The attachment adaptor 56 also includes an adaptor-protruding segment 62 protruding from the adaptor sleeve section 58. The attachment slot 36 formed in the adaptor-protruding segment 62 typically corresponds to the attachment slot configuration of either the 10 or 10*a* in accordance with the first or second embodiments previously disclosed.

The attachment adaptor 56 is preferably provided with an adaptor locking means for locking the attachment adaptor 56 to the handle body 24. In the embodiment illustrated throughout the FIGS. 4 and 5 the locking means includes a frictional contact between the sleeve channel inner surface and the handle body 24.

In use, when the conventional razor handle is used, the attachment adaptor 56 may be easily retrofitted over the longitudinal end of the razor handle by sliding the attachment adapter 56 thereover. Regardless of the embodiment, the razor handles 10 through 10*c* allow an intended user to store the razor handle in a convenient location with a set of ergonomic steps. Once the shaving operation is over, the intended user merely needs to position the supporting components such as the supporting stem 22 substantially in register with the insertion segment 40. The use of an insertion segment 40 extending through the lateral or end peripheral surface of the handle body 24 of the attachment means 36, or the adaptor protruding segment 62, allows the razor handles 10 through 10*c* to be suspended from the attachment structures forming closed loops such as the supporting stem 22 shown in FIG. 1.

Once the supporting stem 22 is positioned substantially in register with the insertion segment 40, the user merely needs to slide the supporting stem 22 into the insertion segment 40 until it reaches the retention segment 38.

The retention segment 38 being positioned substantially opposite the body first end 28 to which the conventional razor blade 12 is attached, the weight of the latter ensures that the razor handle 10 will remain substantially safely suspended from the supporting stem 22. Furthermore, the razor head 12 being positioned underneath the handle 10 allows for safe manipulation of the handle 10 as it is attached to and removed from the supporting stem 22.

Furthermore, positioning of the razor head 12 below the handle 10 ensures that water, shaving cream, sections of removed hair and other debris will fall towards the ground surface instead of dripping along the handle 12. Accordingly, the handle 10 is allowed to dry in a clean state so as to remain clean for the next shaving operation. Still further, positioning of the retention segment axis 42 in a generally co-linear relationship relative to the handle longitudinal axis 26 further improves the overall stability of the handle 10 when in its suspended state. When the razor handle 10 needs to be removed from the supporting stem 22, the latter is merely slid out of the retention end insertion slots 38, 40 through a simple, quick and ergonomical maneuver.

Figure 6:
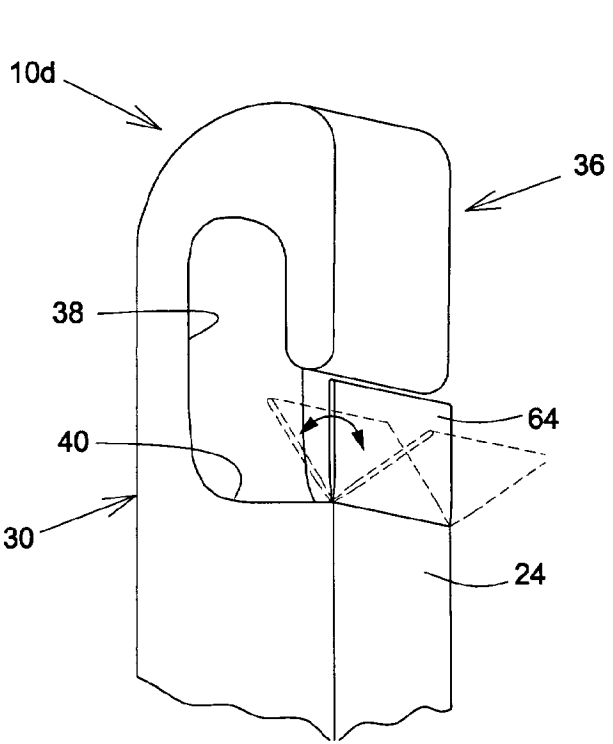
FIG. 6, in a close-up detailed view with sections taken out, illustrates a fifth embodiment of a razor handle having an attachment structure with a flap in accordance with the present invention.

Optionally, the attachment means 36 is further provided with an insertion segment blocking means for blocking the insertion segment 40 so as to selectively prevent withdrawal of the supporting stem 22 therefrom. In the embodiment of the razor handle 10*d* illustrated in FIG. 6, the insertion segment blocking means includes a flap 64 extending across the insertion segment 40. The flap 64 is pivotable, preferably by resiliency, to a flap open configuration, shown in dotted lines in FIG. 6, wherein it allows the passage of the supporting stem 22 from a nominal flap blocking configuration, shown in solid lines in FIG. 6, wherein it prevents the passage of the supporting stem 22. Typically, the flap 64 extends longitudinally from a surface of the insertion segment 40 adjacent the lateral surface of the handle body 24.

Although the present razor handle having an attachment structure has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A razor handle for supporting a razor head, said razor handle being attachable to a supporting stem, said razor handle comprising:

a generally elongated body, said body defining a body longitudinal axis, a body first end and a generally opposed body second end;

a razor head attachment means for attaching said razor head to said razor handle adjacent said body first end, said razor head attachment means being at least partially coverable on an external surface thereof by said razor head;

a handle-to-stem attachment means for attaching said razor handle adjacent said body second end to said supporting stem, said handle-to-stem attachment means including an attachment slot, said attachment slot defining a retention segment and an insertion segment, said retention segment defining a retention segment longitudinal axis extending in a generally parallel relationship relative to said body longitudinal axis, said insertion segment leading into said retention segment, said insertion segment allowing said stem to be inserted into said retention segment and said retention segment allowing said razor handle to be suspended from said supporting stem with said razor head positioned substantially underneath said body second end, said handle-to-stem attachment means being provided with an insertion segment blocking, means for blocking said insertion segment so as to selectively prevent withdrawal of said supporting stem therefrom.

2. A razor handle as recited in claim 1 wherein said insertion segment defines an insertion segment axis extending in a generally perpendicular relationship relative to said retention segment axis.

3. A razor handle as recited in claim 2 wherein said insertion segment extends through a side peripheral edge of said body and merges with said retention segment.

4. A razor handle as recited in claim 1 wherein said handle-to-stem attachment means is formed integrally with said body adjacent said body second end, said attachment slot extending into said body.

5. A razor handle as recited in claim 1 wherein said attachment slot is provided with a generally rounded contour having rounded corners.

6. A razor handle as recited in claim 1 wherein said insertion segment blocking means includes a flap extending longitudinally across said insertion segment and resiliently pivoting to a flap open configuration from a flap blocking configuration wherein it allows and prevents passage of said supporting stem therethrough, respectively.

7. A razor handle as recited in claim 6 wherein said flap extends from a surface of said insertion segment adjacent a lateral surface of said handle body.

* * * * *